US007357088B1

(12) United States Patent
Bowlus

(10) Patent No.: US 7,357,088 B1
(45) Date of Patent: Apr. 15, 2008

(54) ADJUSTABLE MAGNETIC EMBROIDERY HOLDER

(76) Inventor: Monier Bowlus, 1117 Stapleton La., Flower Mound, TX (US) 75028

( * ) Notice: Subject to any disclaimer, the term of this patent is extended or adjusted under 35 U.S.C. 154(b) by 52 days.

(21) Appl. No.: 11/557,898

(22) Filed: Nov. 8, 2006

(51) Int. Cl.
*D05C 9/04* (2006.01)
*D05B 39/00* (2006.01)

(52) U.S. Cl. ..... 112/103

(58) Field of Classification Search ..... 112/103, 112/117, 470.14, 475.18; 101/127.1; 38/102.2, 38/102; 160/371, 378, 380
See application file for complete search history.

(56) References Cited

U.S. PATENT DOCUMENTS 5,138,960 A * 8/1992 Inteso ..... 112/103
5,144,899 A * 9/1992 Allen ..... 112/103
5,546,877 A * 8/1996 Moore ..... 112/103
5,970,895 A * 10/1999 Mack ..... 112/103
6,293,038 B1 * 9/2001 Chang ..... 40/738
6,298,800 B1 * 10/2001 Gala ..... 112/103
7,194,967 B2 * 3/2007 Bowlus ..... 112/103

* cited by examiner

*Primary Examiner*—Ismael Izaguirre
(74) *Attorney, Agent, or Firm*—Christopher P. O'Hagan; David W. Carstens; Carstens & Cahoon, LLP

(57) ABSTRACT

The present invention provides an embroidery holder assembly that includes a metal frame that fits within an embroidery hoop used in an embroidery machine. Magnets are used to hold fabric to the metal frame in the embroidery hoop, wherein the magnet may be repositioned along the metal frame. The holder assembly includes a holder plate that fits over the metal frame within the embroidery hoop and holds the fabric between itself and the metal frame. The holder plate has a cutout section that defines an embroidering area in which the embroidering machine stitches a pattern. The holder plate also has slots on the sides that overlie the metal frame. The magnets are placed in these side slots to secure the holder plate to the metal frame and can be repositioned along the length of the peripheral slots.

9 Claims, 12 Drawing Sheets

ADJUSTABLE MAGNETIC EMBROIDERY HOLDER

TECHNICAL FIELD

The present invention relates generally to embroidery machinery and more specifically to an apparatus for securing cloth and other embroidering surfaces in place in a machine without the need for adhesive chemicals, adhesive backings or traditional hooping methods.

BACKGROUND OF THE INVENTION

Though modern machinery has largely automated the process of embroidering clothing and patches, current embroidery methods still require a considerable amount of user input. This not only increases the time requirement for the embroidery process but also leaves opportunities for human error and increased equipment maintenance. In addition, current embroidery methods involve the use of adhesive chemicals, adding to the cost of production and exposing some users to potentially harmful chemicals. In addition, the use of modern hoops can damage fragile embroiderables such as velvet, sheer and paper products and in the case of smaller embroiderables hooping can be very difficult.

FIG. 1 shows a typical embroidery machine well known in the art. Using a series of needles 101, each with its own thread, the machine 100 embroiders patterns in the center of a plastic hoop 102 that is secured to the frame of the machine.

FIG. 2 shows a closer view of an embroidery hoop 102. In this view one can see the tear away backing material 201 that is secured to the hoop 102.

Some machines are capable of holding multiple hoops and embroidering several patterns at once. In addition, the size and shape of the hoop may also vary. However, the operation of these different machines works along the same lines.

A pattern to be embroidered is first created by a digitizer, who by means of a computer converts a design to stitches in a format that the embroidery machine can understand. The design to be digitized can be a computer image file of various formats, or it can be on printed paper or in the imagination of the digitizer. Once the digitized design is completed, the operator of the embroidery machine uploads the digitized design into the embroidery machine by means of, e.g., a floppy disc, CD-ROM, memory card, and in some cases the design is transferred directly to the embroidery machine before embroidery or little by little through a network cable during the stitching process.

Before securing the fabric within the hoop, the user applies an adhesive spray 302 to the backing material 301. The embroidery machine is then started, and the automated embroidery process continues until the embroidered pattern is finished. After the embroidery design is finished, the backing material is simply torn away from the fabric.

As an alternative to the tear away backing and spray-on adhesive, a self-adhesive, tear-away paper backing can be used in the hoop to secure the fabric in place. However, the general process is virtually the same. In this case, the backing is removed to expose the adhesive before the fabric is placed onto the exposed adhesive paper.

The current approach described above has several disadvantages. Though aligning the fabric within the hoop is fairly simple, there is the possibility of human error, resulting in misalignment of the embroidery design on the fabric. The adhesive itself may also be insufficient to prevent the fabric from shifting during the embroidery process.

In addition, the spray-on adhesive can also interfere with the operation of the embroidering machine as the adhesive has a tendency to build up on the sewing needles and can even cause threads to break, requiring the machine to be stopped and the needles rethreaded. The cumulative cost of the spray-on adhesive or self-adhesive paper also contributes considerably to the cost of production.

An alternative method is to clamp the fabric directly to the hoop and a tear-away cut-away backing material. However the clamping process when hooping fabrics can damage fragile fabrics such as velvet.

Therefore, it would be desirable to have a method for properly securing fabric in the embroidering machine without the need for applying adhesive chemicals or expensive self-adhesive backings to secure the fabric as well as reducing the likelihood of human error in the alignment of the fabric and damaging the fabric in the process.

SUMMARY OF THE INVENTION

The present invention provides an embroidery holder assembly that includes a metal frame that fits within an embroidery hoop used in an embroidery machine. Magnets are used to hold fabric to the metal frame in the embroidery hoop and position the fabric in relation to the needles of the embroidery machine, wherein the magnet may be repositioned along the metal frame as needed by the user. The number of magnets may vary according to the needs of the user and the size of the fabric.

In the preferred embodiment, the holder assembly also includes a holder plate that fits over the metal frame within the embroidery hoop and holds the fabric between itself and the metal frame. The holder plate has at least one cutout section that defines an embroidering area in which the embroidering machine stitches a pattern. The holder plate also has slots on the sides that overlie the metal frame. The magnets are placed in these side slots to secure the holder plate to the metal frame and can be repositioned along the length of the peripheral slot as desired by the user.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
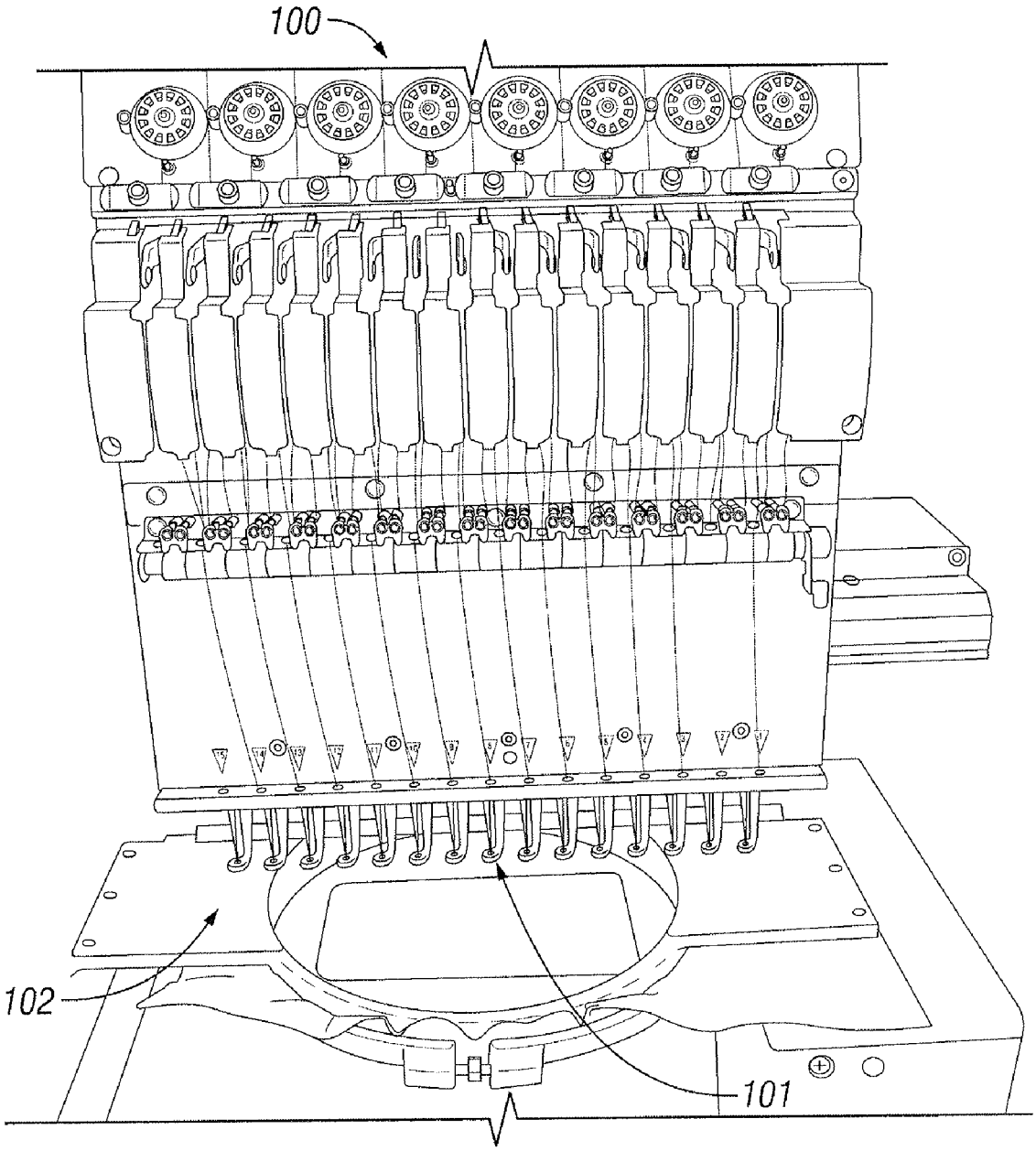
FIG. 1 shows a typical embroidery machine well known in the art.
Figure 2:
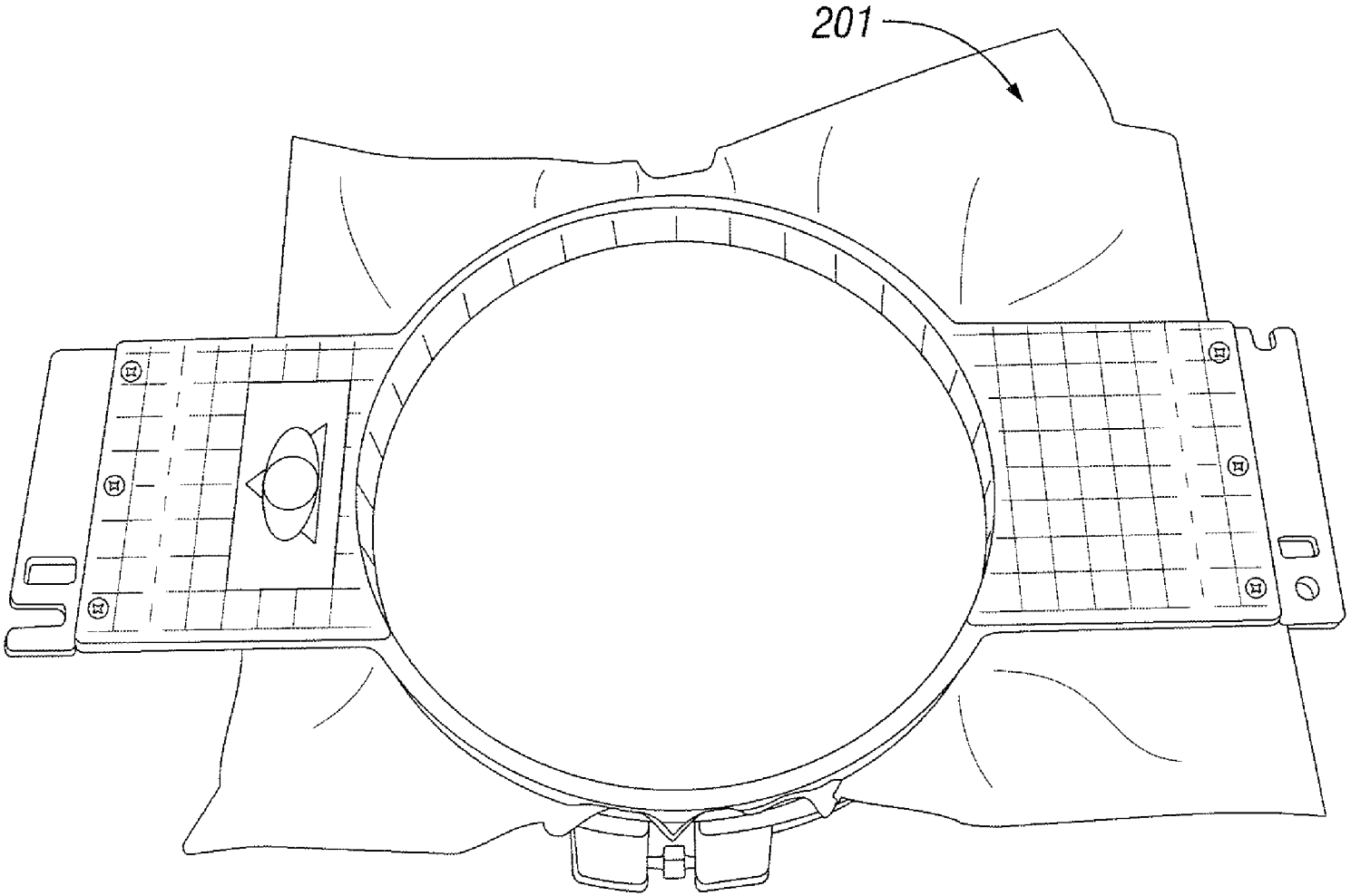
FIG. 2 shows a closer view of a hoop used to hold fabric in place for the embroidery machine.
Figure 3:
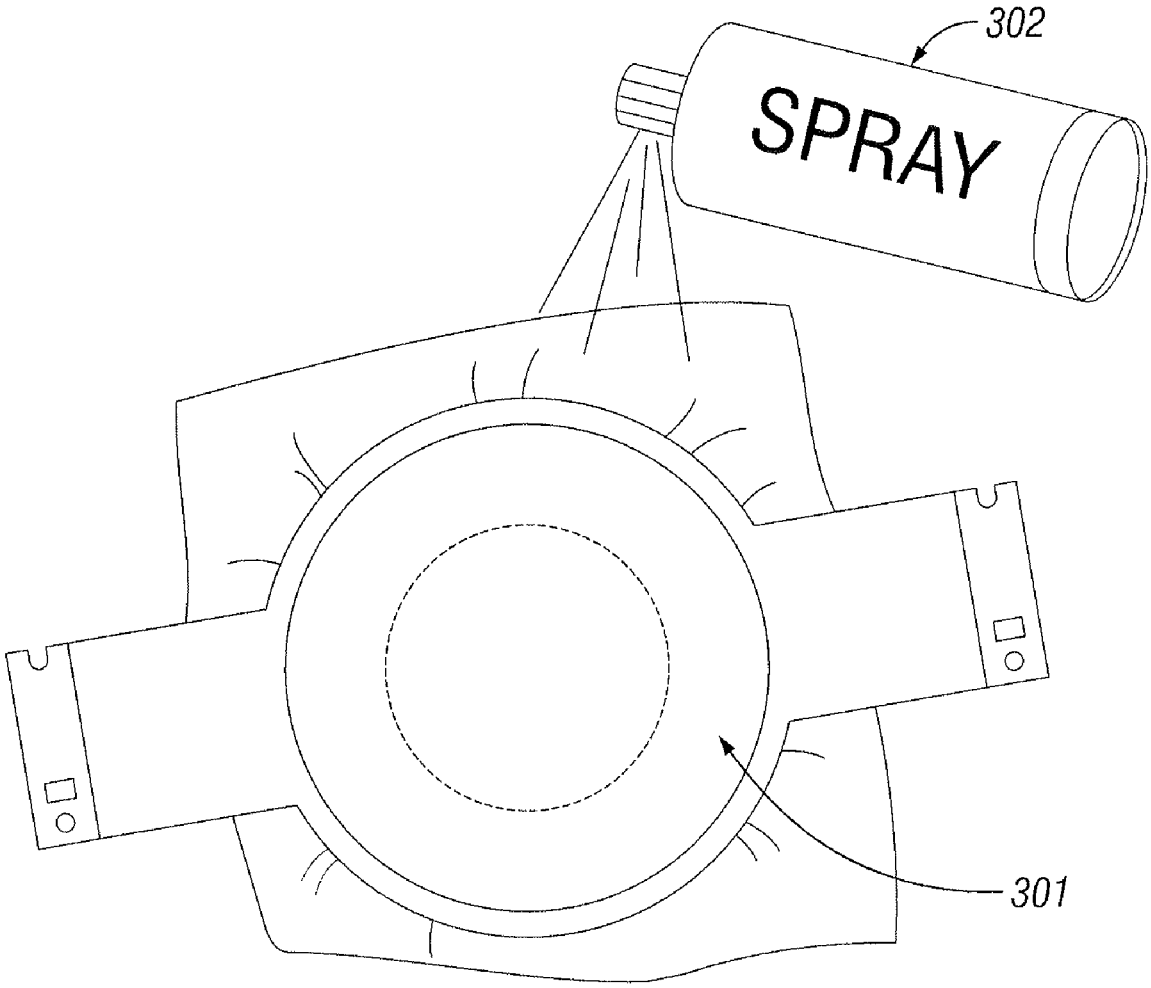
FIG. 3 shows the application of adhesive to the backing material in the hoop.
Figure 4:
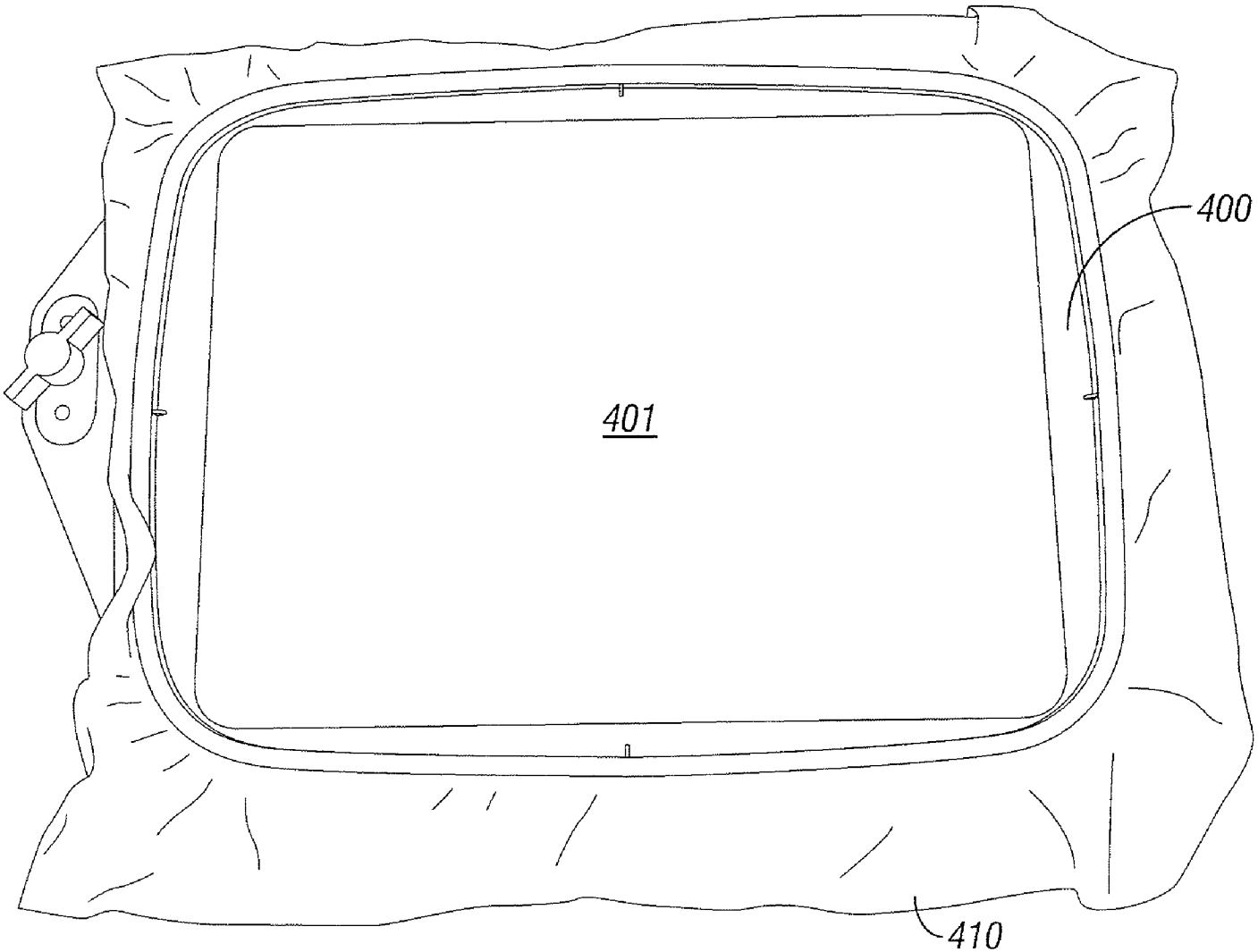
FIG. 4 shows an embroidery hoop in accordance with a preferred embodiment of the present invention.

FIG. 4 shows an embroidery hoop in accordance with a preferred embodiment of the present invention. The embroidery hoop 400 has a large cutout area 401 in the center. However, this cutout area 401 covers most of the area within the hoop 400. Also pictured is a piece of backing material 410 secured within the hoop 400. and is approximately the same size as the embroidery holder plate (as illustrated in FIG. 7).

Figure 5:
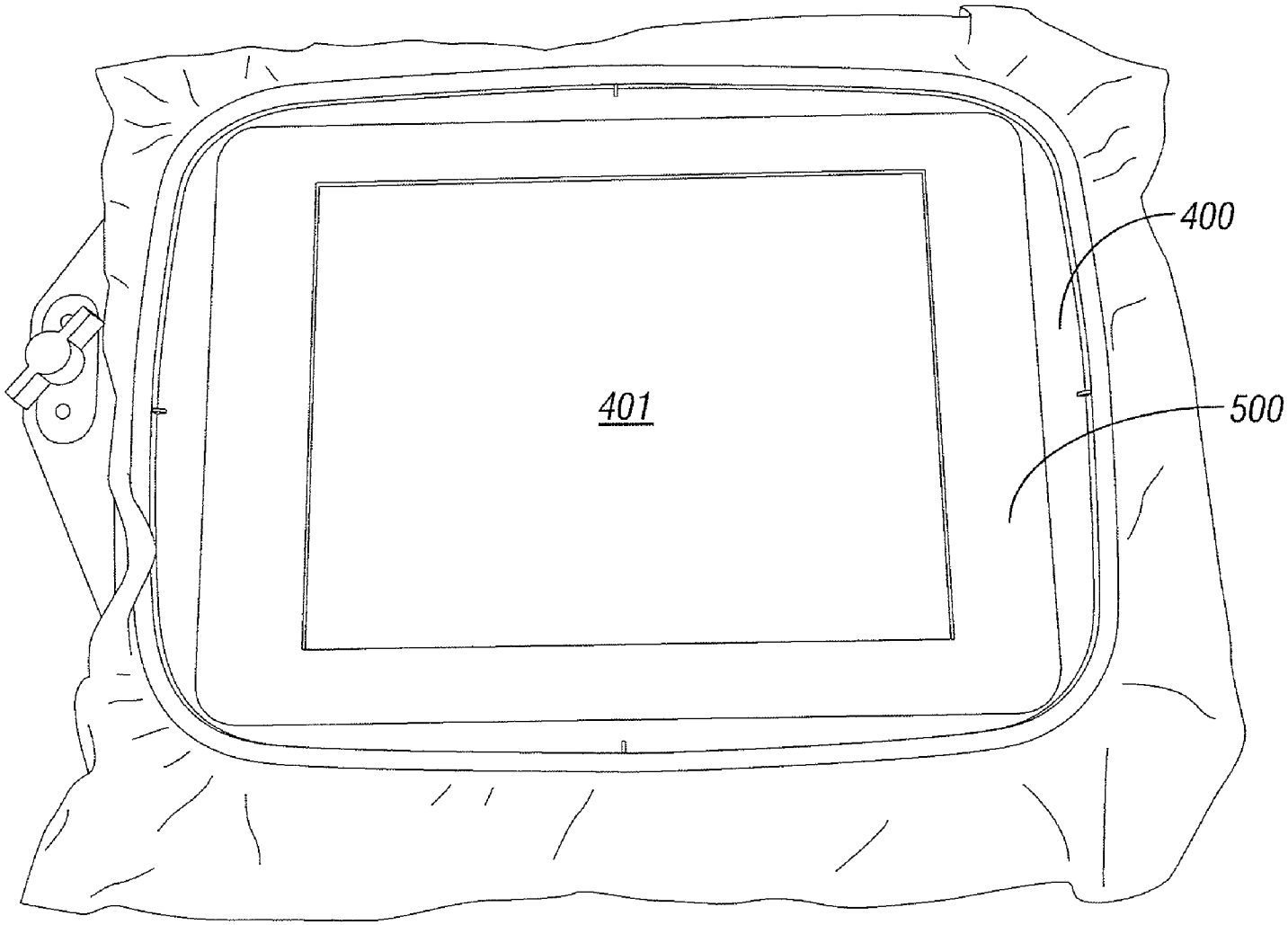
FIG. 5 shows the embroidery hoop with a metal frame inserted into the cutout in accordance with a preferred embodiment of the present invention.

FIG. 5 shows the embroidery hoop with a metal frame inserted into the cutout in accordance with a preferred embodiment of the present invention. The metal frame 500 acts as an anchor to which the embroidered fabric may be secured via magnets. As illustrated in the figure, the frame 500 fits within the perimeter of the hoops cutout area 401.

Figure 6:
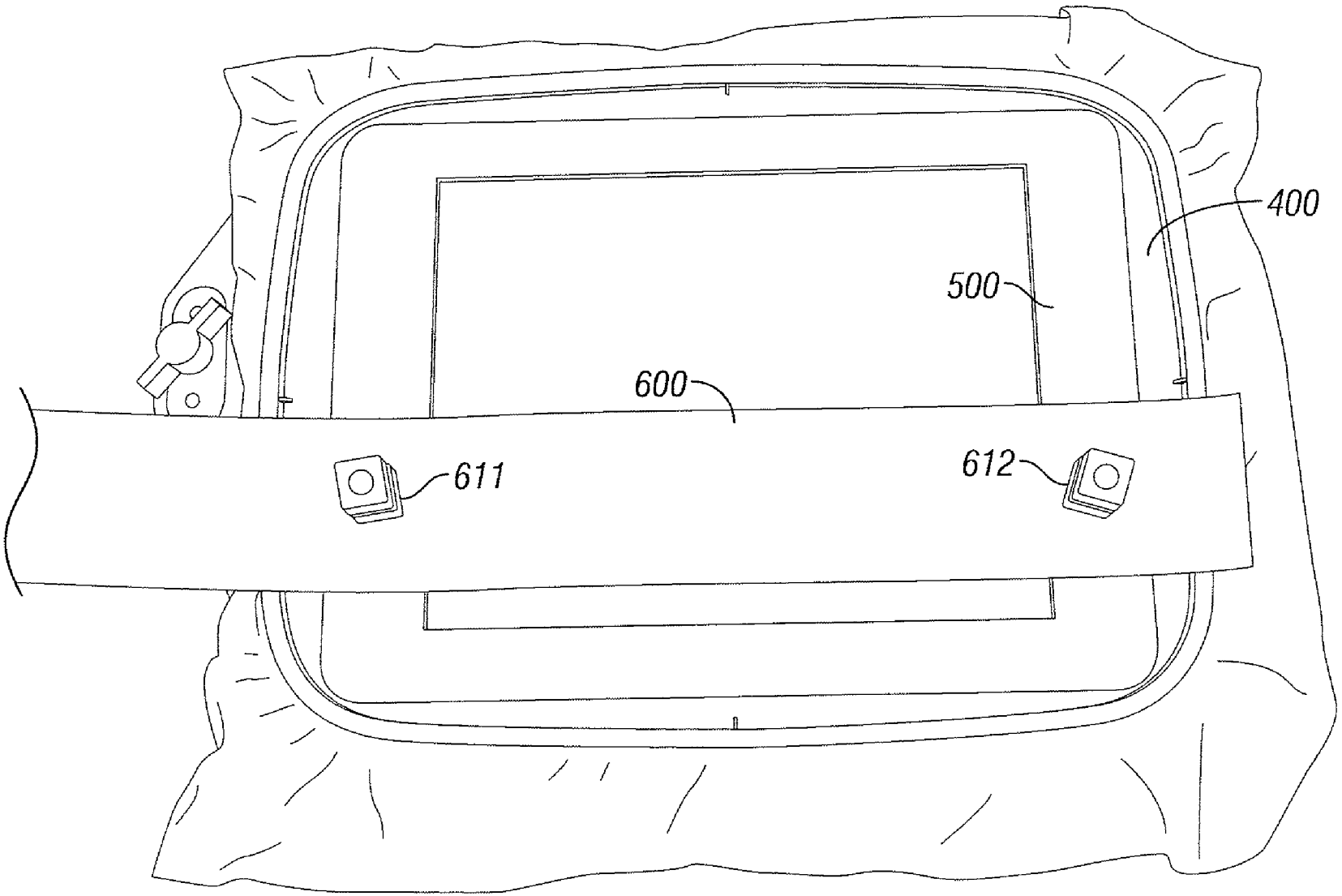
FIG. 6 shows a piece of fabric secured to the metal frame by movable magnets in accordance with a preferred embodiment of the present invention.

FIG. 6 shows a piece of fabric 600 secured to the metal frame 500 by movable magnets 611, 612 in accordance with a preferred embodiment of the present invention. The metal frame 500 and magnets 611, 612 replace expensive traditional chemical sprays and adhesive backings used to position fabric for embroidery. This arrangement provides the user with a considerable degree of freedom in positioning the fabric 600 within the hoop 400. The magnets 611, 612 can be arranged at any point on the metal frame 500 as necessary to hold the fabric 600 in place. Additional magnets may also be used depending on the size of the fabric and the necessary positioning under the embroidering needles.

Figure 7:
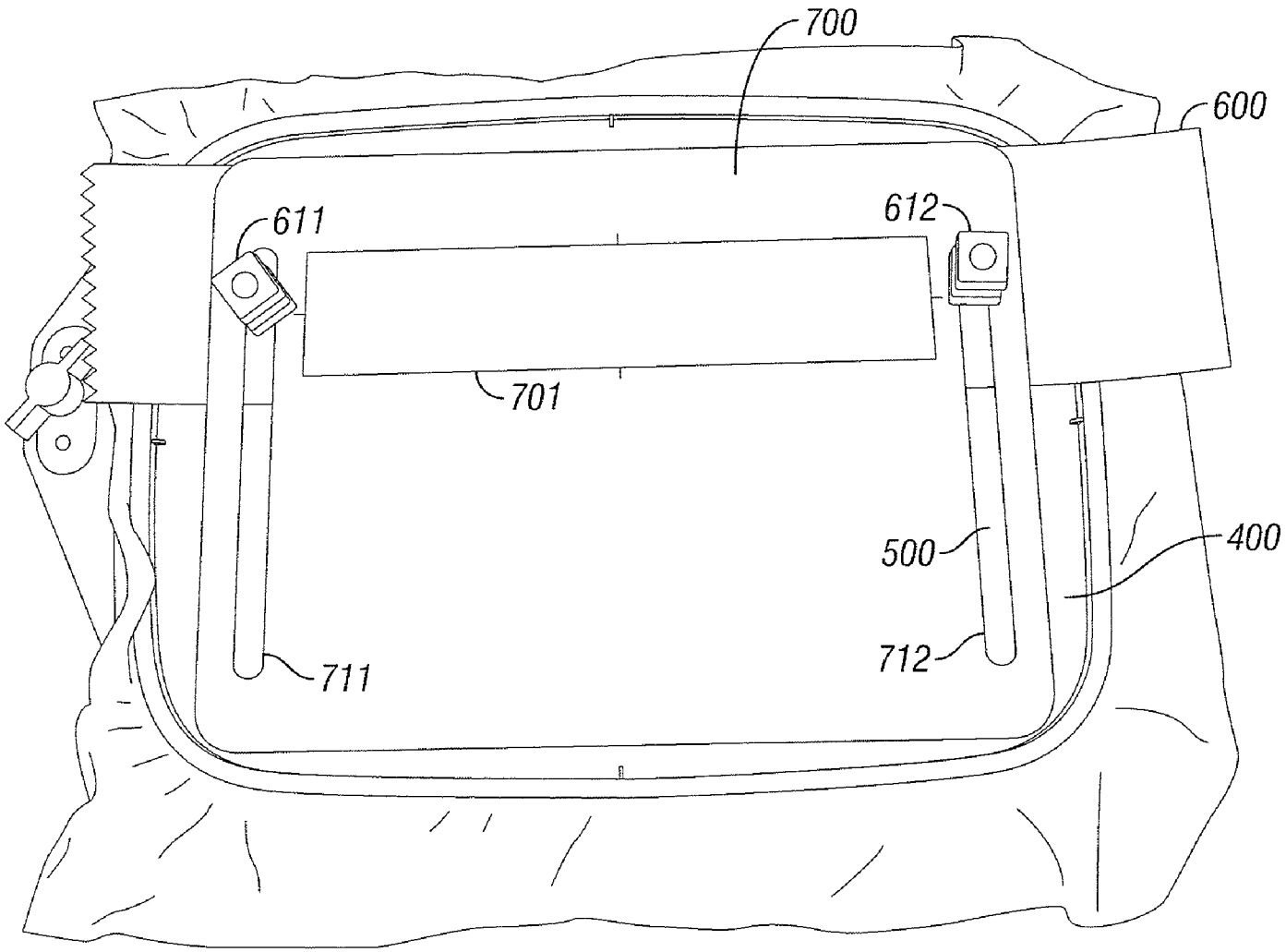
FIG. 7 shows an embroidery holder in the embroidery hoop, securing a piece of fabric within the hoop in accordance with a preferred embodiment of the present invention.

FIG. 7 shows an embroidery holder plate in the embroidery hoop, securing a piece of fabric within the hoop in accordance with a preferred embodiment of the present invention. The holder plate 700 is a pre-shaped template that helps hold fabric in position. It is approximately the same size as the metal frame 500 and fits within the cutout area of the embroidery hoop 400. The center of the holder plate 700 has a cutout section 701 corresponding to the area of the fabric that is to be embroidered.

Once the metal frame 500 is placed within the hoop 400, the fabric 600 to be embroidered is placed over the hoop and frame. The embroidery holder plate 700 is then place over the metal frame 500. In the preferred embodiment of the present invention, the magnets 611, 612 are arranged within the peripheral (side) slots 711, 712 which overlay the metal frame 500. As shown in FIG. 7, the magnets 611, 612 secure both the fabric 600 and the holder plate 700 to the metal frame 500.

The holder plate 700 is able to secure the fabric 600 and hold it down more effectively than the magnets 611, 612 alone. In the present example, the cutout shape for the embroidery area 701 is a simple rectangle, but the cutout can be any shape or size that can fits within the borders of the metal frame 500.

The example depicted in FIG. 7 also illustrates the usefulness of providing elongated side slots 711, 712 for the magnets 611, 612, allowing the magnets to be moved and place as needed by the user. The fabric sample 600 shown only covers part of the area of the hoop 400 and metal frame 500. The user can position the magnets 611, 612 within the side slots 711, 712 at the position where they will provide the most hold. Since the fabric 600 in this example only needs to be secured under the cutout area 701 of the holder plate 700, the magnets 611, 612 are placed near the top of the side slots 711, 712.

Figure 8:
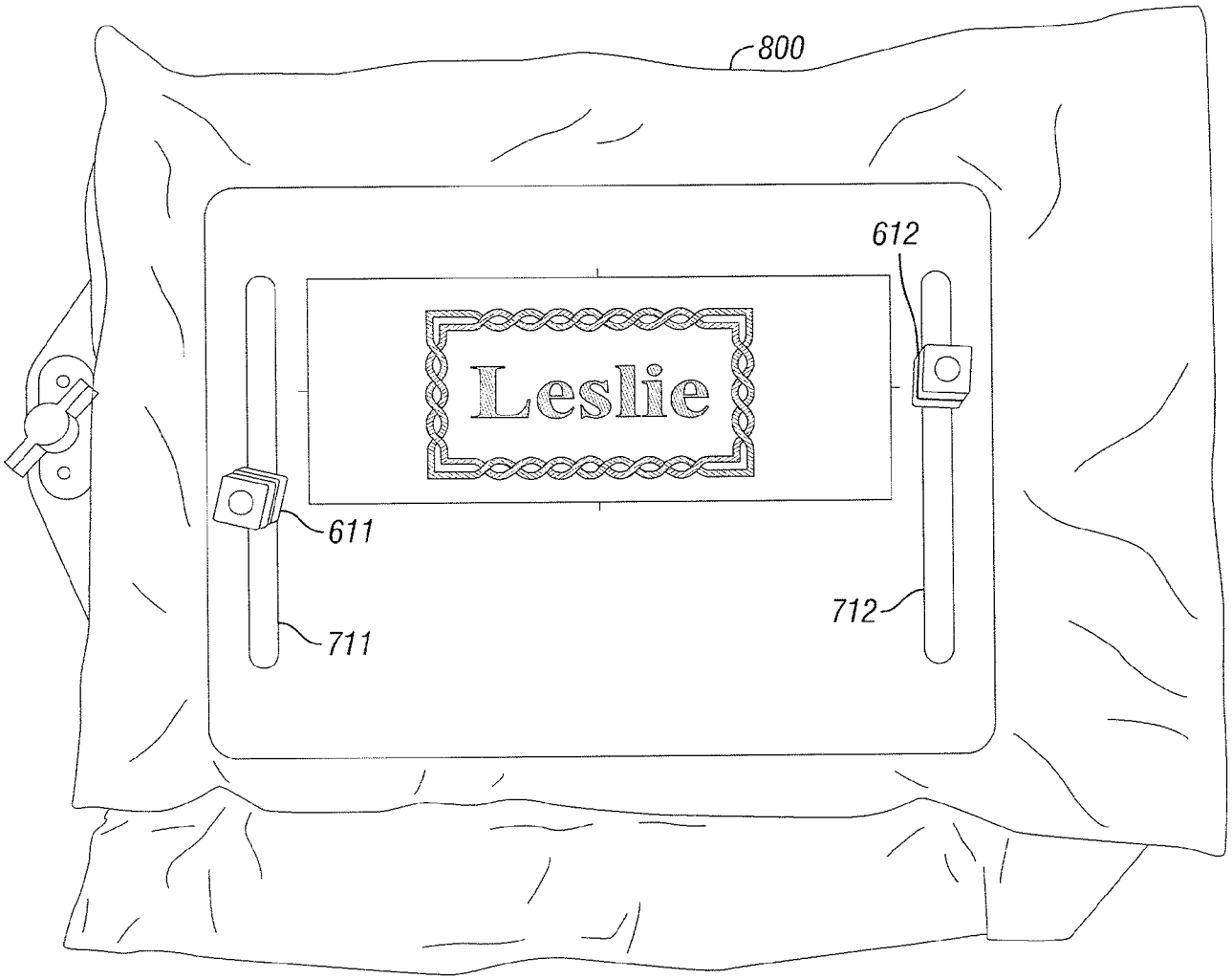
FIG. 8 shows a completed embroidery design in the embroidery holder.

FIG. 8 shows a completed embroidery design in the embroidery holder. This example shows a larger piece of fabric 800 that covers the entire area of the hoop. As such, the magnets 611, 612 are placed more centrally within the side slots 711, 712 to allow a more even distribution of holding force. It should also be emphasized that additional magnets may be used to provide multiple securing positions along the lengths of the side slots when securing larger pieces of fabric.

While the above description covers an embroidery holder plate with a rectangular cutout section, the present invention may be used with a variety of embroidery holder plate having cutout sections of various sizes and shapes.

Figure 9:
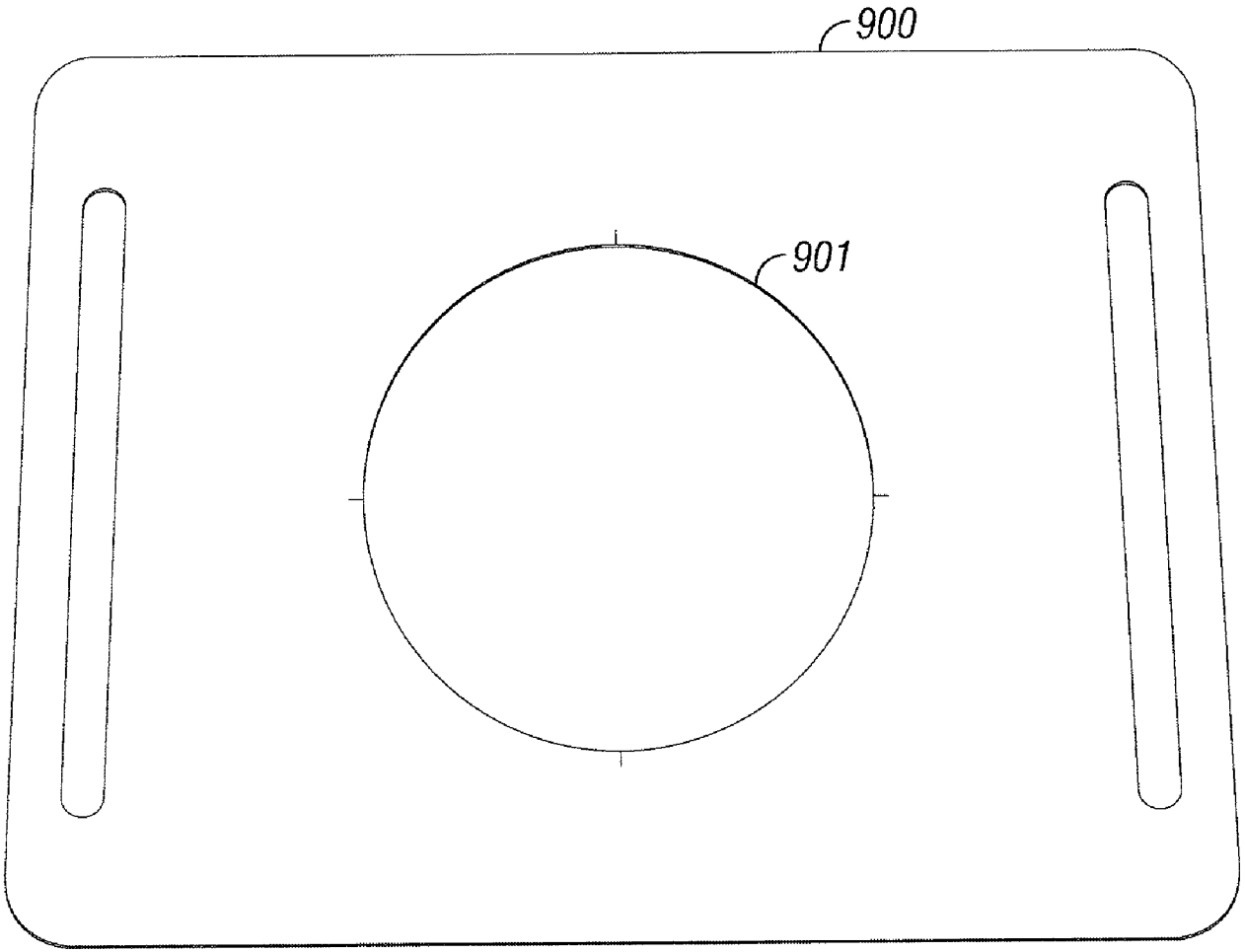
FIG. 9 shows an embroidery holder plate with a circular cutout in accordance with an embodiment of the present invention.

FIG. 9 shows an embroidery holder plate 900 with a circular cutout 901 in accordance with an embodiment of the present invention.

Figure 10:
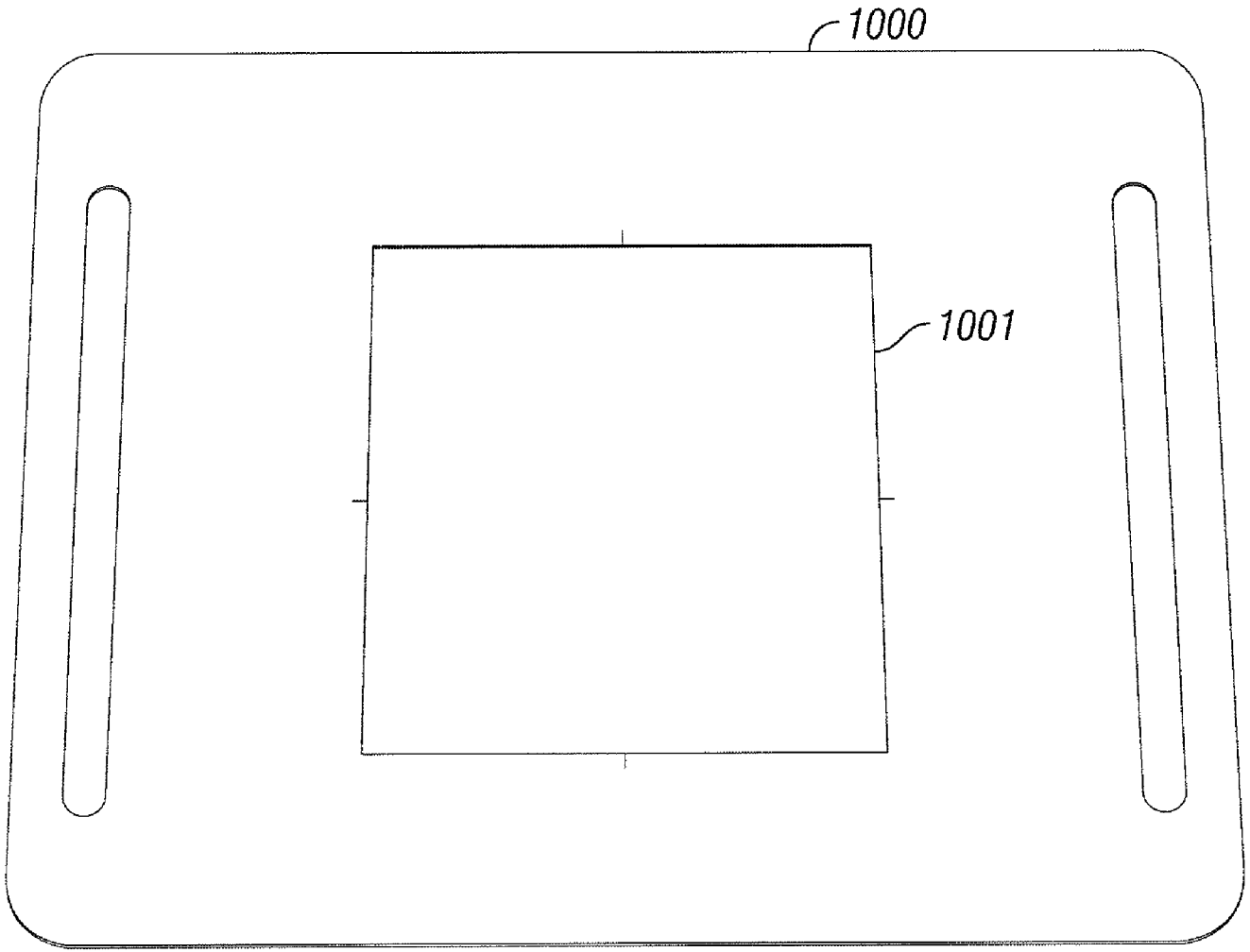
FIG. 10 shows an embroidery holder plate with a square cutout in accordance with an embodiment of the present invention.

FIG. 10 shows an embroidery holder plate 1000 with a square cutout 1001 in accordance with an embodiment of the present invention.

Figure 11:
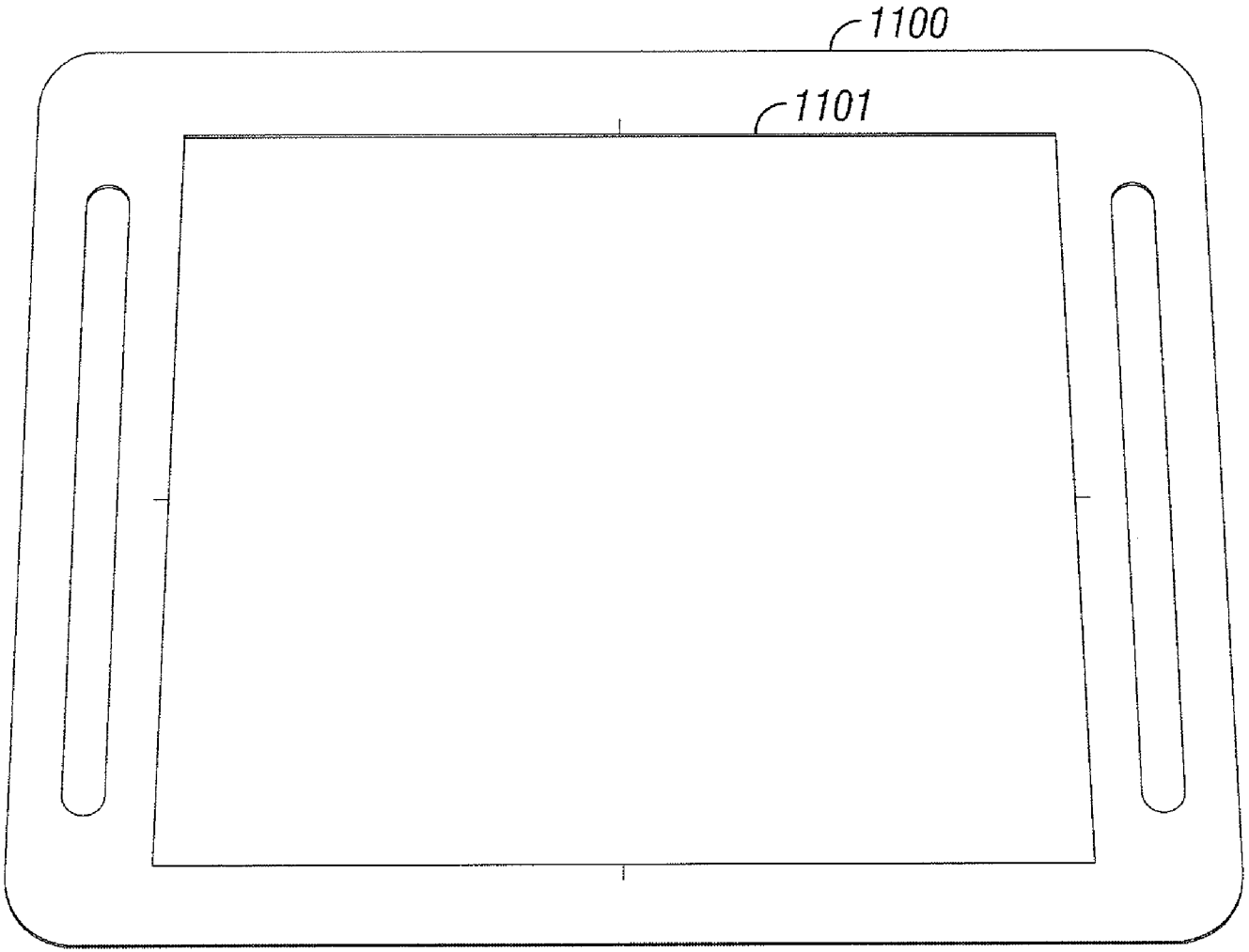
FIG. 11 shows an embroidery holder plate with a larger square cutout in accordance with an embodiment of the present invention.

FIG. 11 shows an embroidery holder plate 1100 with a larger square cutout 1101 in accordance with an embodiment of the present invention. In this example, the area of the cutout 1101 closely matches the cutout area of the metal frame, allowing the largest possible embroidering area for that size of hoop and frame.

The example cutout shapes and sizes depicted in FIGS. 9-11 are merely illustrative examples. The cutout sections may come in other shapes and sizes. In addition, some holder plate may have multiple cutout sections.

Despite the differences in the cutout sections depicted in FIGS. 9-11, the embroidery holder plate 900, 1000 and 1100 cover the same area and have their respective side slots located in the same place, allowing all of the holder to be used with the same hoop/metal frame assembly depicted in FIG. 6.

The present invention may also be applied to hoop shapes different from the rectangular hoop 500 depicted in FIG. 5.

Figure 12:
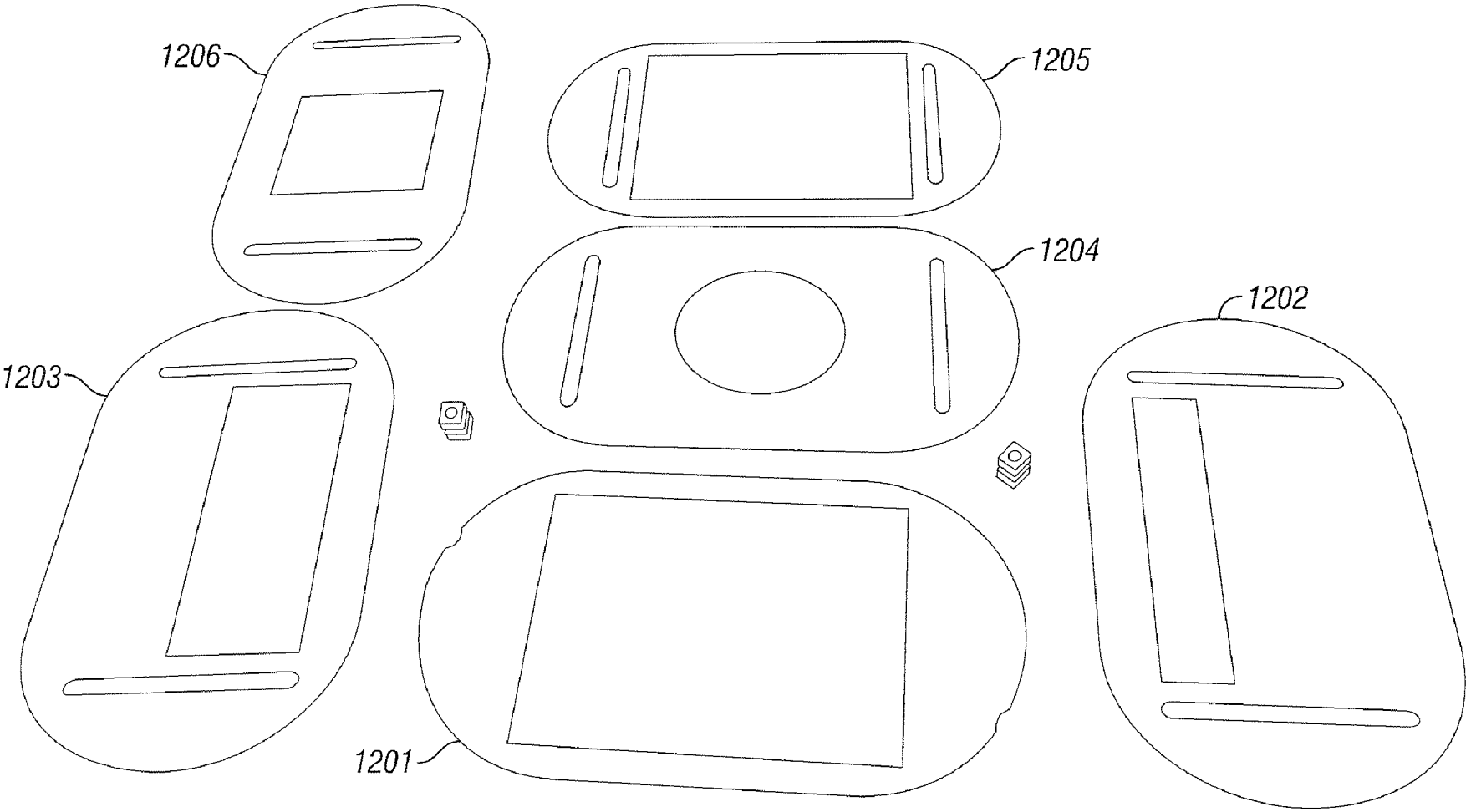
FIG. 12 shows an embroidery holder set compatible with a more oval shaped embroidering hoop in accordance with an alternate embodiment of the present invention.

FIG. 12 shows an embroidery holder set compatible with a more oval shaped embroidering hoop in accordance with an alternate embodiment of the present invention. In this embodiment, the metal frame 1201 has an elongated shaped with rounded ends. Holder plate with various cutout sizes and shapes are sized to fit directly over the metal frame 1201. Like the example above, the holder cutout shapes include small rectangle 1202, large rectangle 1203, circle 1204, large square 1205, and small square 1206.

The embroidery holder set can be made from a variety of inexpensive materials such as plastic, PVC, PVC foamboard (Celtec®), Styrene (vinyl benzene), Polycarve™ (high density polyethylene), acrylic (Plexiglas, Lucite®), pressed balsa wood, processed wood materials such as Formica® (plastic laminate) or Masonite® (engineered wood), Lexan® (polycarbonate thermoplastic resin), rigid textile materials, metal, rubber or similar materials. In the preferred embodiment of the invention, the holder plate is approximately 0.2-5 mm thick. The metal frame is also approximately 0.2-5 mm thick.

An advantage of the present invention is the elimination of adhesive chemicals for securing the fabric in place. This significantly reduces the cost of embroidering. Currently, adhesive spray retails for about $15.00 per 18 oz. can and self-adhesive backings sell for about $0.30 per square foot, verses the cost of the traditional tear-away backing used with the present invention, which costs about $0.08 per square foot.

In addition to this direct cost savings, the invention also reduces the time and cost associated with needle replacements due to needles being clogged with chemical adhesive. Along those same lines, there is additional time saving due to fewer interruptions from thread breaks because the needles run cooler and cleaner without chemicals.

Since most of the adhesive sprays are also highly flammable, users must comply with several federal, state and local regulations regarding the shipment, storage and handling of these chemicals. The present invention allows businesses and operators to completely avoid this inconvenience and expense.

In addition to significant cost reduction, there are potential health benefits from avoiding chemicals that could be a cause of health problems. The present invention does not leave a sticky residue on the fabric, badge, needles, employees, or equipment. With the level of concern regarding environmental pollutants and spiraling health costs concerns, any elimination of unnecessary chemicals from the workplace is welcome.

In addition the present invention makes it easier to secure smaller fabrics and items such as bookmarks, neck ties and other small and/or narrow materials for the embroidering process.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. An embroidery holder assembly comprising:

(a) a metal frame that fits within an embroidery hoop used in an embroidery machine; and (b) at least one movable magnet, wherein the magnet is used to hold fabric to the metal frame in the embroidery hoop and position the fabric in relation to the needles of the embroidery machine, wherein the magnet may be repositioned along the metal frame.

2. The embroidery holder assembly according to claim 1, further comprising:

(d) a holder plate that fits over said metal frame within the embroidery hoop and holds fabric between itself and the metal frame;

wherein the holder plate has at least one cutout section that defines an embroidering area in which the embroidering machine stitches a pattern; and wherein the holder plate has at least one peripheral slot that overlies said metal frame, wherein said magnet is placed in the peripheral slot and secures the holder plate to the metal frame, and wherein said magnet can be repositioned along the length of the peripheral slot.

3. The embroidery holder assembly according to claim 1, wherein the thickness of the metal flame is between 0.2 mm and 5 mm inclusive.

4. The embroidery holder assembly according to claim 2, wherein the thickness of the holder plate is between 0.2 mm and 5 mm inclusive.

5. The embroidery holder assembly according to claim 2, wherein the holder plate is made from one of the following materials:

plastic;
balsa wood;
plastic laminate;
engineered wood;
polycarbonate thermoplastic resin;
rigid textile materials;
metal;
rubber;
high density polyethylene;
PVC;
PVC foamboard;
vinyl benzene; and
acrylic.

6. The embroidery holder assembly according to claim 2, wherein the holder plate can be used with any embroidery digitizing software and design format.

7. The embroidery holder assembly according to claim 2, wherein the holder plate further comprises multiple embroidery cutout sections.

8. The embroidery holder assembly according to claim 2, wherein the holder plate further comprises multiple peripheral slots for said magnet.

9. The embroidery holder assembly according to claim 1, further comprising multiple magnets.

* * * * *

UNITED STATES PATENT AND TRADEMARK OFFICE

CERTIFICATE OF CORRECTION

PATENT NO. : 7,357,088 B1
APPLICATION NO. : 11/557898
DATED : April 15, 2008
INVENTOR(S) : Monier Bowlus It is certified that error appears in the above-identified patent and that said Letters Patent is hereby corrected as shown below:

In the Specification:
In column 2, line 9, please insert --or-- between “tear-away” and “cut-away.”

Signed and Sealed this

Eighth Day of July, 2008

JON W. DUDAS
*Director of the United States Patent and Trademark Office*